US009708784B2

(12) United States Patent
Winter et al.

(10) Patent No.: US 9,708,784 B2
(45) Date of Patent: Jul. 18, 2017

(54) PUSHER PLOW BLADE SYSTEM

(71) Applicants: Kent Winter, Willoughby, OH (US); William A. Sulesky, Medina, OH (US)

(72) Inventors: Kent Winter, Willoughby, OH (US); William A. Sulesky, Medina, OH (US)

(73) Assignee: Winter Equipment Company, Willoughby, OH (US)

( * ) Notice: Subject to any disclaimer, the term of this patent is extended or adjusted under 35 U.S.C. 154(b) by 0 days.

(21) Appl. No.: 14/847,960

(22) Filed: Sep. 8, 2015

(65) Prior Publication Data

US 2016/0069032 A1 Mar. 10, 2016

Related U.S. Application Data

(60) Provisional application No. 62/046,385, filed on Sep. 5, 2014.

(51) Int. Cl.
*E01H 5/06* (2006.01)

(52) U.S. Cl.
CPC ..... *E01H 5/066* (2013.01); *E01H 5/061* (2013.01)

(58) Field of Classification Search
CPC ..... E01H 5/065; E01H 5/066; E01H 5/067
USPC ..... 37/270; 280/28
See application file for complete search history.

(56) References Cited

U.S. PATENT DOCUMENTS

| | | | | | |
|---|---|---|---|---|---|
| 1,581,414 | A * | 4/1926 | Young | E02F 3/8157 | 172/393 |
| 1,713,882 | A * | 5/1929 | Shaw | E02F 3/8157 | 280/28 |
| 2,202,309 | A * | 5/1940 | Campbell | B62B 19/00 | 280/28 |
| 2,460,348 | A * | 2/1949 | Henry | E02F 3/8157 | 172/832 |
| 2,593,025 | A * | 4/1952 | Hanson | B62B 15/00 | 280/28 |
| 3,685,177 | A | 8/1972 | Hahn et al. | | |
| 4,441,266 | A * | 4/1984 | Westimayer | E01H 5/098 | 172/393 |
| 5,148,616 | A | 9/1992 | Maguina-Larco | | |
| 5,553,409 | A | 9/1996 | Irving | | |
| 5,724,755 | A | 3/1998 | Weagley | | |
| 6,041,529 | A | 3/2000 | Ruvang | | |
| 6,792,704 | B2 * | 9/2004 | Johnson | E01H 5/06 | 172/261 |
| 7,100,314 | B1 * | 9/2006 | Jensen | E01H 5/066 | 172/816 |
| 7,266,914 | B2 | 9/2007 | Grant | | |
| 7,596,895 | B2 | 10/2009 | Jones | | |
| 7,836,615 | B2 | 11/2010 | Winter | | |
| 7,874,085 | B1 | 1/2011 | Winter et al. | | |
| 8,024,874 | B2 | 9/2011 | McClanahan et al. | | |
| 8,191,287 | B2 | 6/2012 | Winter et al. | | |

(Continued)

*Primary Examiner* — Gary Hartmann
(74) *Attorney, Agent, or Firm* — Fay Sharpe LLP

(57) ABSTRACT

A pusher plow blade system includes a blade with horizontal and vertical reinforcing channels. The pusher plow includes side plates or vertical plates extending forward from each end of the blade. Each side plate includes a plurality of modular independently movable and independently replaceable skid shoes or wear shoes for sliding contact with the ground surface. The removable and repositionable skid shoes comprise replaceable cast steel wear parts.

17 Claims, 5 Drawing Sheets

(56) References Cited

U.S. PATENT DOCUMENTS

| | | | | |
|---|---|---|---|---|
| 8,544,856 | B2 * | 10/2013 | Sayre | E01H 5/066 280/28.17 |
| 8,844,173 | B2 | 9/2014 | Winter et al. | |
| 9,163,379 | B2 * | 10/2015 | Winter | E01H 5/061 |
| 2005/0126051 | A1 * | 6/2005 | Fatemi | E01H 5/066 37/266 |
| 2012/0260537 | A1 | 10/2012 | Winter et al. | |
| 2015/0047234 | A1 | 2/2015 | Winter | |
| 2016/0010314 | A1 * | 1/2016 | Kassander | E02F 3/8152 37/453 |

* cited by examiner

PUSHER PLOW BLADE SYSTEM

This application claims priority to U.S. Provisional Patent Application No. 62/046,385, filed Sep. 5, 2014, by Kent Winter et al. and entitled "SNOW PUSHER PLOW BLADE SYSTEM" and is incorporated herein by reference in its entirety.

BACKGROUND

Snow pushers and pusher box blades of various configurations are presently known. They are typically characterized by one or more of the following: a relatively complex mounting arrangement, a steel blade as the snow scraper, a relatively light construction backed with ribs and angles, and poor performing fabricated high carbon alloy steel skid shoes.

Usually the heavy steel cutting or wear edges of pusher plow blades and fabricated pusher plow skid shoes are expendable and can be removable, e.g., with bolts, to the bottom of, for example, a plow mold board. As a pusher blade scrapes along the pavement or ground, it wears. The wear often is uneven, and the blades and skid shoes sometimes break during plowing. All of this maintenance and the associated down time are costly.

The pusher blade on typical snow pushers are subjected to extensive vibration, impact, and abrasive action, resulting from the scraping action between the cutting edge of the blade and the road bed over which the machine travels. As a result, the blade edge and the skid shoes wear and chip due to the abrasion and impact and must be replaced frequently. This is a costly proposition because of the downtime of the associated machine and cost expended in man power and materials to make a blade changeover. Present configurations for the skid surfaces of a pusher box plow generally entail a single fabricated wear shoe running the complete fore and aft length of opposing side walls of the pusher plow. These known prior art devices are relatively bulky, expensive to manufacture and replace, and difficult to install on the pusher plow side walls.

Thus, there has been a need for an improved means which supports the pusher blade from the road bed or parking lot road surface therebelow for reducing or dampening the undesirable vibrating, impact, and abrasive action on the blade. In particular, there has been a need for an improved modular grouping of a plurality of individual independently movable and independently replaceable skid shoes that maintain sliding contact with the ground surface therebelow. The plurality of skid shoes can comprise replaceable cast steel wear parts.

Objects of this invention are to provide skid shoes comprising replaceable cast steel wear parts. Further objectives include the skid shoes being modular and independently mounted to the snow pusher box including independent contact with the ground surface. The skid shoe can include a hardened wear surface (i.e. carbide matrix weldment) in contact with ground surface as the snow pusher is pushed along the ground surface. The present invention also incorporates a plurality of individual independently mountable and/or pivotable skid shoes including individual independent, self-leveling, replaceable, rotatable, and/or reversible skid shoes.

BRIEF DESCRIPTION

One aspect of the present disclosure provides for a plow blade system which can comprise a blade with horizontal and vertical reinforcing channels. The blade further includes side plates extending forward from each end of the blade. Each side plate can include a plurality of individual independently movable and independently replaceable skid shoes for independent sliding contact with the ground surface therebelow. The plurality of skid shoes comprise replaceable cast steel wear parts.

Another aspect of the disclosure provides for a pusher plow blade system, comprising: a blade with horizontal and vertical reinforcing channels, the blade further including side plates extending forward from opposing ends of the blade, wherein each side plate includes a modular array of individual independently movable and independently replaceable skid shoes for independent sliding contact with the ground surface therebelow and, wherein said plurality of skid shoes comprise replaceable cast steel wear parts. The modular array of skid shoes include a direction of travel when in an engaged position. The modular array of skid shoes include a series of at least two skid shoes for attachment to each opposing side plate. Each skid shoe can include an elastomeric mount for pitch movement up and down, and roll movement side to side when the modular array of skid shoes are moving in the direction of travel.

A still further aspect of the present disclosure provides for an expendable wear part adapted for replaceable attachment, comprising a wear part including a unified steel casting having a mounting surface and a wear surface. The wear part comprises a skid shoe including a direction of travel when in an engaged position. Each skid shoe independently moveable and independently replaceable for independent sliding contact with a ground surface therebelow. The wear surface comprises an array of at least four individual independently moveable skid shoes. Each of the skid shoes rotatable from a first mounted position with any other of the skid shoes in a second mounted position.

DETAILED DESCRIPTION

Figure 1:
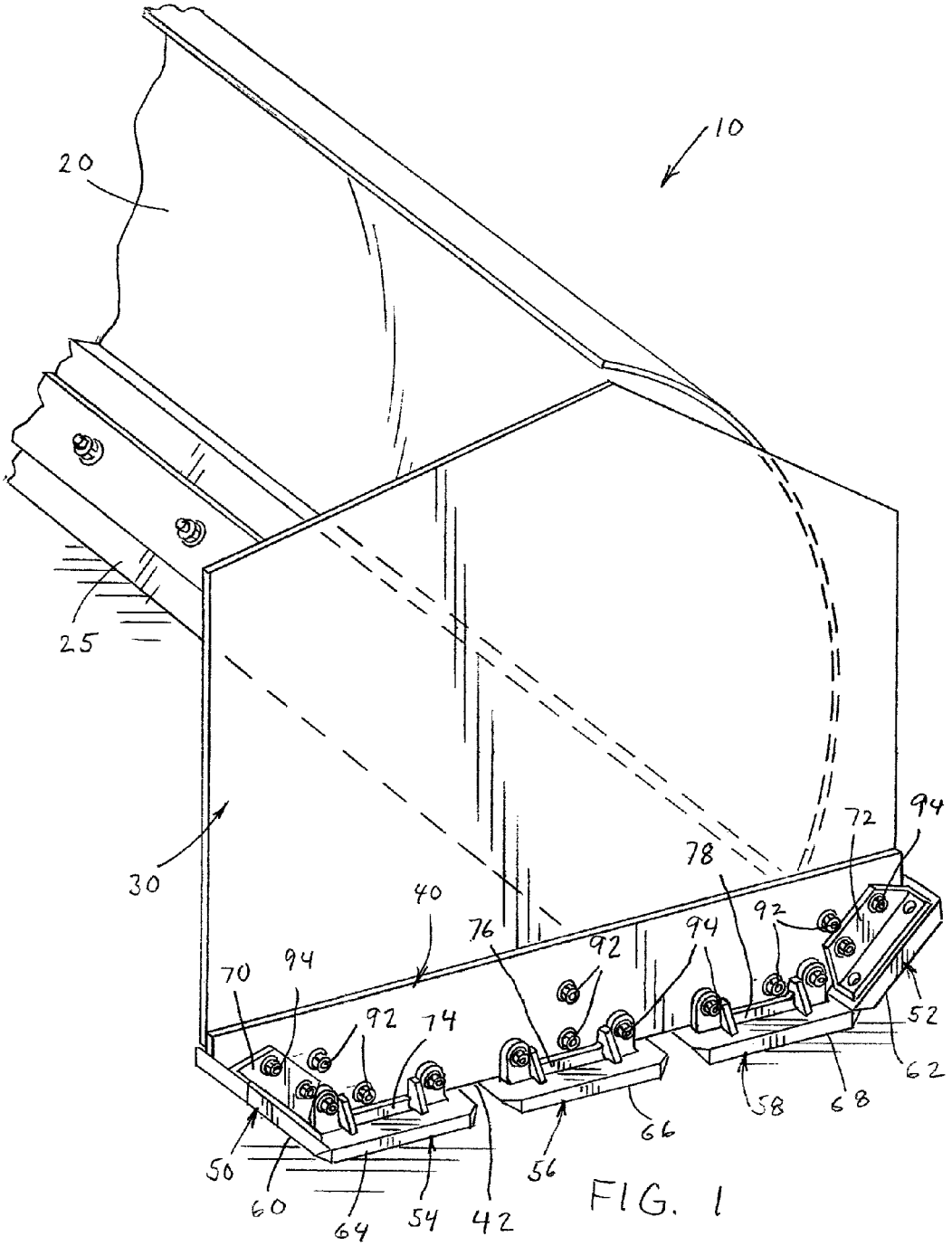
FIG. 1 is a perspective view of a pusher plow and one vertical side plate along with a plurality of skid shoes mounted to a side adapter blade.
Figure 2:
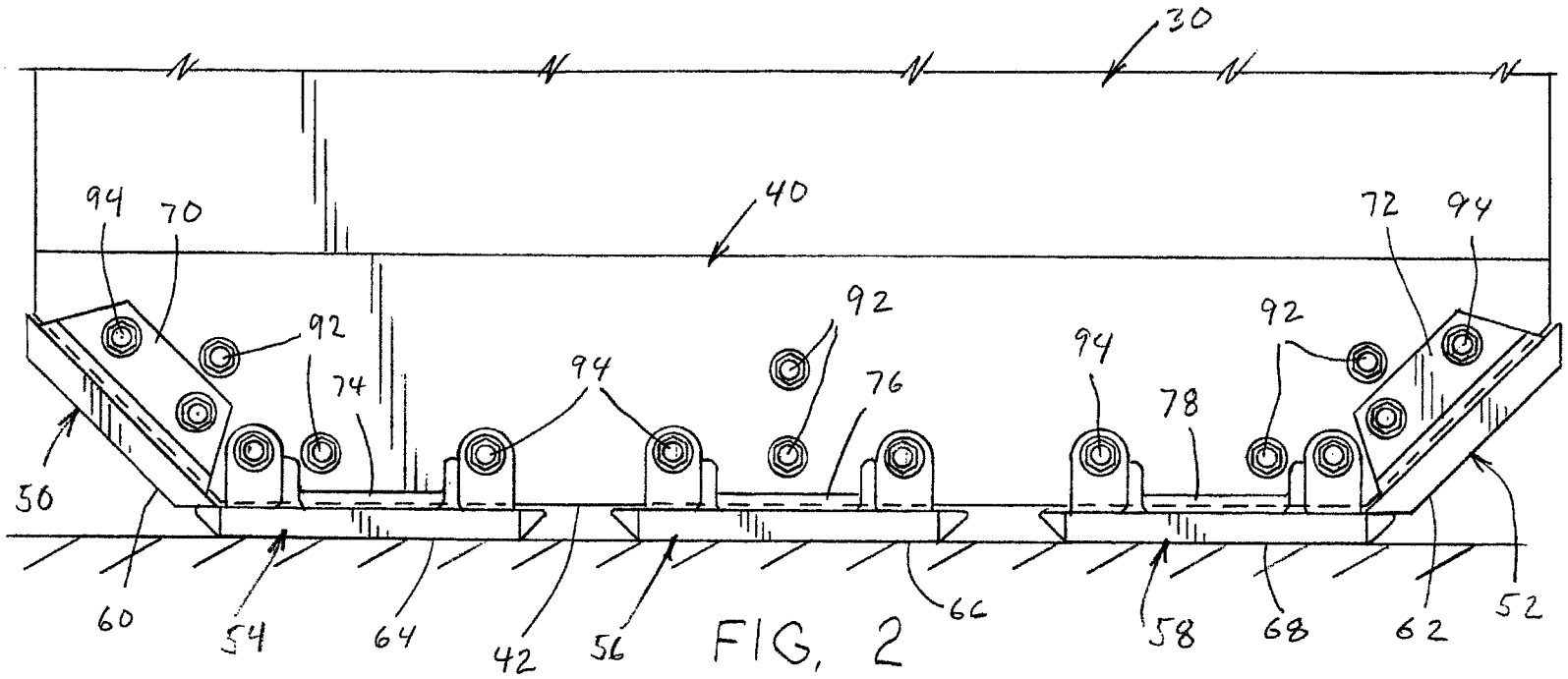
FIG. 2 is a side elevational view of the side adapter blade and a modular array of skid shoes mounted thereto.

Referring now to FIG. 1, the pusher plow 10 includes an upstanding steel blade 20, and a vertical side plate 30 at each end of the blade and extending forward from it. Although not illustrated, it is to be appreciated that the back side of the blade can include horizontal reinforcing channels welded across the width of the blade, vertical reinforcing channels welded between the horizontal channels, and a backing flat stock member behind the bottom edge of the blade and extending the width of the blade. The backing member can be stiffened by gussets spaced on centers along its length. The blade can include an upper horizontal row of posts, and a lower horizontal row of posts, extending out from the lower most horizontal channel on the back of the blade. The parallel upper and lower rows of posts can form a horizontal receptacle or slot between them. A bucket of a front end loader machine can fit within the slot. The bucket can be moveable into and out of the slot, to respectively engage the blade for operation of the pusher plow, and to disengage the blade.

A vertical side plate 30 can extend forward from each end of the blade 20. The side plate can be mounted to the front of the blade 20 by braces. Each side plate 30 can include a side adapter blade 40 and a modular array of removable wear or skid shoes 50, 52, 54, 56, 58 on its bottom edge for sliding contact with the ground surface. The plurality of frame wear shoes 54, 56, 58 can each include a bottom runner 64, 66, 68 and a vertical web 74, 76, 78. Each of the runners, i.e. runner 64, can include grooves or channels 84 along a bottom surface that can be filled or over filled with a reconstitutable abrasion resistant weldment therein. Each of the plurality of wear shoes or skid shoes are independently reversible, rotatable, and replaceable. The wear shoes, by means of their vertical webs, can be removably fastened selectively to either one of the vertical side plates and side adapter blades by bolts.

The fore and aft wear shoes 50, 52 can each include a bottom runner 60, 62 and a vertical web 70, 72. Each of the fore and aft wear shoes 50, 52 can also include mounting openings 75 for mounting to the adapter blade 40 and the vertical side plate 30 with fasteners 94. The fore and aft wear shoes 50, 52 provide a deflective surface against objects in the path of movement as the pusher plow 10 is moved forwardly and rearwardly. The frame wear shoes 54, 56, 58 are the main ground surface contact members and thus bear the majority of the weight of the pusher box blade system 10. The wear shoes 50, 52, 54, 56, 58 are the consumable wear product members of the snow pusher 10, and can be independently and selectively bolt mounted to a side adapter blade for easy rotation and/or replacement when necessary.

The wear resistant surface made in accordance with the teachings of the present disclosure is illustrated in FIGS. 1-5B. Skid shoes 50, 52, 54, 56, 58 can be used to reduce the extensive vibration, impact, and abrasive action between the cutting edges of plow blade 20 and side adapter blades 40, and the associated skid shoes along the roadbed over which the pusher plow 10 travels. In one mounting arrangement, a modular array of skid shoes 50, 52, 54, 56, 58 can be mounted to each side plate on opposing sides of the blade 20.

The skid shoes 50, 52, 54, 56, 58 can be mounted to the side adapter blade 40 which can be secured to the side plate 30 at bolt holes 90. The shoes 50, 52, 54, 56, 58 can be mounted close to a terminal edge 42 of adapter blade 40. The present modular construction eliminates the bulky supporting structure of a one piece fabricated skid shoe, thereby reducing the time and cost of fitting the skid shoes onto the pusher plow 10. Further, mounting hardware enables wear shoes and structures to become shock and impact absorbers for the pusher plow.

As shown, the side adapter blade 40 includes a set of spaced apart mounting openings 90, such that adapter blade 40 may be mounted to the vertical side plate 30 fasteners 92. In one mounting arrangement, the frame skid shoes 54, 56, 58 reside close to the blade 40 terminal edge 42 and thus are a more integral part of the pusher blade system 10 and, therefore, capable of absorbing more of the undesirable abrasive wear.

The frame skid shoes 54, 56, 58 further include respectively generally horizontal skid or wear surface 64, 66, 68. One or more cavities can be cast into the frame skid shoes 54, 56, 58 at the time of casting (see for example, FIG. 3C). The skid shoes 50, 52, 54, 56, 58 can be cast from steel for greater strength and resiliency.

The steel casting can take on the following analysis (balance iron).

| C | Mn | P | S | Si | Cr | B | Hardness Bhn |
|---|---|---|---|---|---|---|---|
| X100<br>16 | X100<br>140 | X100<br>16 | X100<br>16 | X100<br>525 | X100<br>26 | X100<br>0.4 | 363/401 |

Figure 3B:
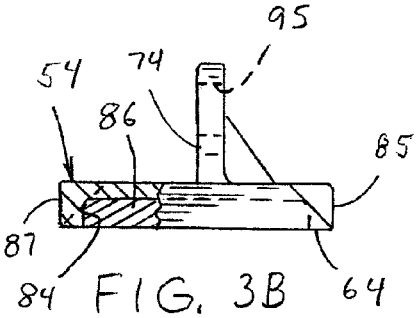
FIG. 3B is a partial cross-sectional front view of the frame shoe of FIG. 3A.
Figure 3A:
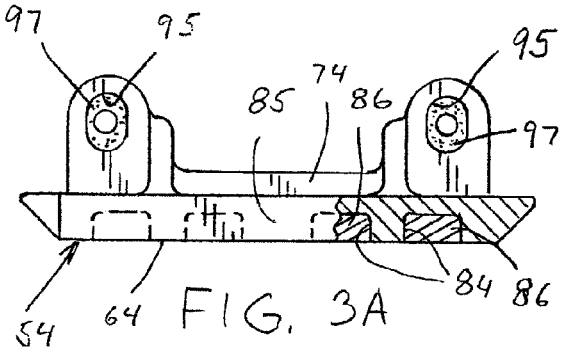
FIG. 3A is a partial cross-sectional side elevational view of a frame shoe.
Figure 3C:
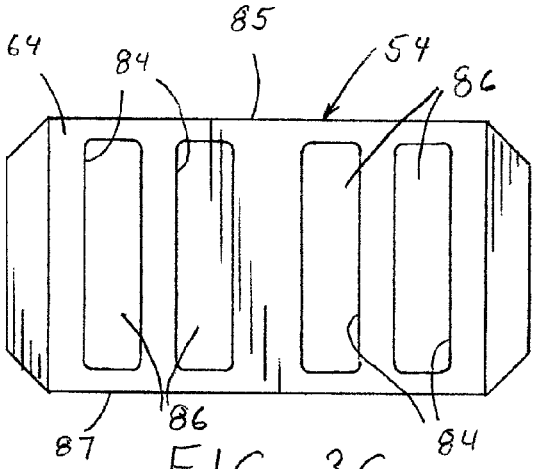
FIG. 3C is a bottom elevational view of the frame shoe of FIG. 3A.
Figure 4C:
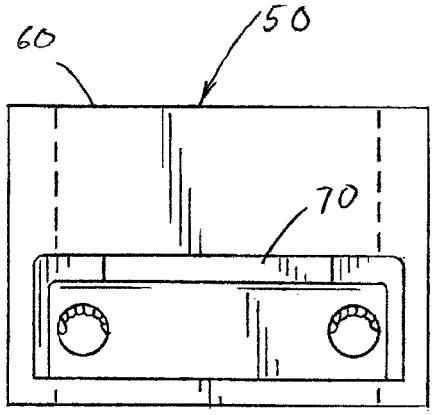
FIG. 4C is a top view of the fore and aft skid shoe of FIG. 4A.
Figure 4B:
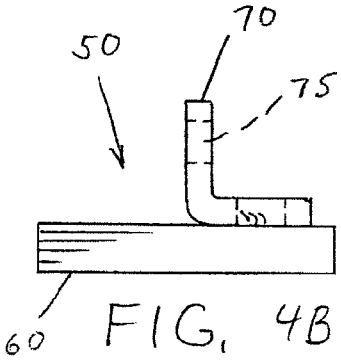
FIG. 4B is a front elevational view of the fore and aft skid shoe of FIG. 4A.
Figure 4A:
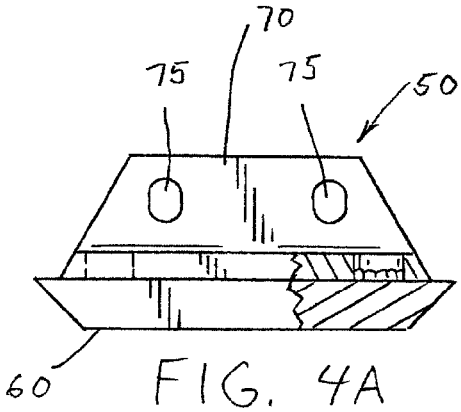
FIG. 4A is a partial cross-sectional side elevational view of a fore and aft skid shoe.
Figure 5A:
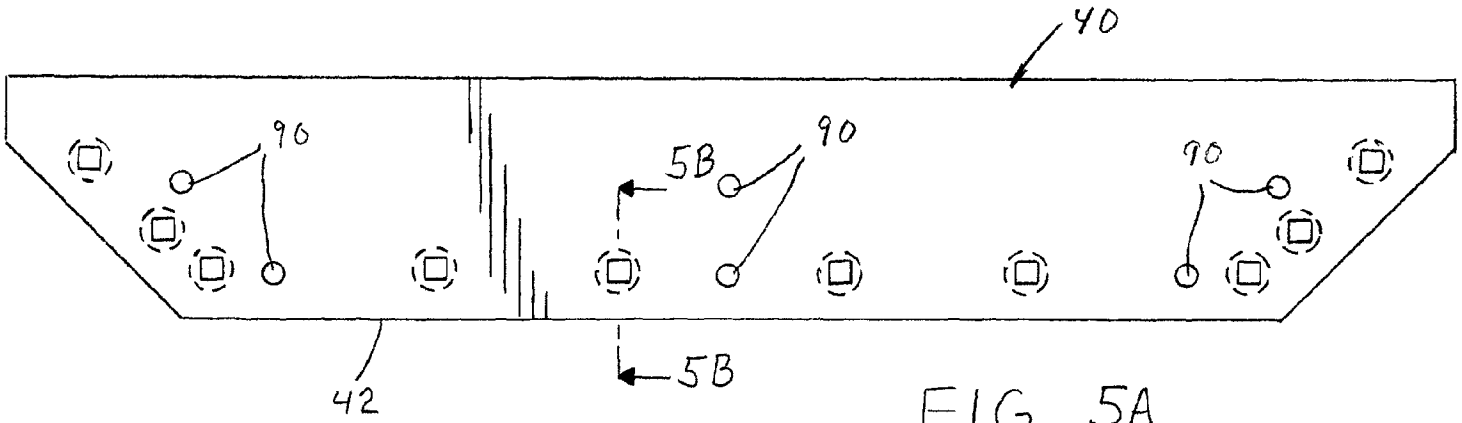
FIG. 5A is a side elevational view of the side adapter blade.
Figure 5B:
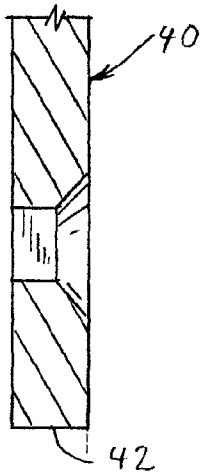
FIG. 5B is a cross-sectional view along line 5B-5B of FIG. 5A.

The greater the impact resistance, shear strength, and hardness of the sections, generally the better. Accordingly, armor steel castings can be used, typically ones with high chromium, carbon and silicon contents. Other armor steels, quenched and tempered ultraservice steels, and maraging steels also are useful here. The casting process can include the provision of one or more cavities 84 in association with the wear surface 64 (FIG. 3C).

It is to be appreciated that subsequent to casting, the cavities 84 can be filled and/or overfilled by welding therein a layered carbide matrix 86. The layered carbide matrix 86 can be composed of a series of layered deposits one on top of another until the cavity is filled or overfilled. Overfilling the cavity can result in a convex or bulbous layer of carbide matrix terminating beyond, i.e. extending below, the wear surface of the skid shoe (not illustrated). The matrix 86 provides a reconstitutable embedded weldment or resistor for increased wear resistance of the wear surface. In one exemplary embodiment, four longitudinal cavities 84 extend along substantially the length of the wear surface 64. The cavities 84 can be spaced from one another and proximal to opposing edges 85, 87, respectively, of the skid shoe 54.

The weldments 86 can comprise a weight of between 1 and 4 pounds. The weldments can increase the weight of each shoe from about 5% to about 20%. The plurality of weldments 86 can be aligned with the wear surface such that when the plow is in use and traveling along the road surface, the weldments are transverse to the direction of travel. Alternatively, the weldments can be aligned such that they are aligned with the direction of travel.

The weld deposits can have the following analysis (balance iron):

| C | Cr | Mo | Si | Mn | Hardness/Rc |
|---|---|---|---|---|---|
| X100<br>2.60 | X100<br>12.00 | X100<br>0.62 | X100<br>1.37 | X100<br>0.77 | 55-60 |

Conventional hard-facing or wear-facing weldments can be used for the deposits. So-called chrome carbide steels are the most common, e.g., Stoody Company No. 121, although vanadium carbide (Stoody No. 134) and tungsten carbide ones also can be used very effectively. It is to be appreciated that the weldment material deposited in the cavity has a higher hardness than the steel casting. The weldment metal must be abrasion-resistant. Generally, it is a high chrome ferrous metal weld. It is reconstitutable in the sense that it can be repaired or replaced by redeposition of carbide matrix by welding.

The wear surfaces and the embedded or integrated weldments help to support the cutting edges of the blade such that the abrasive action and impact from the roadbed works on the wear surfaces and weldments of the skid shoes instead of the blade cutting edges, thereby substantially prolonging the life of the cutting edges. In addition, the weldments substantially prolong the life of the associated skid shoe due to the wear surface being a combination of carbide matrix and steel casting. The surface area of the weldments can comprise from about 20% to about 60% of the total surface area of the bottom wear surface 64 (FIG. 3C).

The expendable skid shoes are adapted for replaceable attachment to, for example, a plow pusher arrangement. The at least first cavity 84 can include an abrasion-resistant welding deposit (not illustrated) therein for extending the service life of the wear surface of the wear part. Other cavities can include the abrasion-resistant welding deposit therein for further extending the service life of the wear surface 64. The welding deposits can comprise the matrix structure as described above. The cavities 84 can be refilled in order to extend the life of the wear part.

It is to be appreciated that the skid shoes include a set of spaced apart mounting openings such that the skid shoes may be mounted to the adapter blade 40. Other standard mounting hole spacings and arrangements are also within the scope of the present disclosure.

The pusher plow blade can further include a resilient rubber edge 25 mounted along the bottom of the blade, extending a distance therebelow. The rubber edge 25 can be from about 1 to about 3 inches thick and from about 4 to about 10 inches high. Mounting of the rubber edge 25 is adjustable and can be reversed to accommodate for wear. The rubber edge 25 is flexible enough to glide over many ground surface irregularities without gouging asphalt, concrete, or tar gravel surfaces. It also rides easily over grates, manhole covers, and other potential hazards, permitting higher speed and damage-free snow removal. To be described in more detail hereinafter, the modular arrangement of the skid shoes of the present invention also allows for the pusher box to glide over many of the ground surface irregularities without gouging the ground surface. The ground surface is intended as a term to include any surface such as road, parking lot, runway, interior warehouse floor, or the like where the pusher plow can be used. Similarly, rubber is intended as a convenient term to include the entire range of rubbers or elastomers suitable for the use described herein.

Each of the modular skid shoes 50, 52, 54, 56, 58 can be rotated from a right side to a left side, or vice versa, in order to present a different wear edge in a different orientation or direction. In addition, the modular skid shoes can also be moved from a forward position to a rearward position, and vice versa, again to accommodate for different orientations or directions of wear edges and to balance the wear along all edges and faces of the modular skid shoes.

In one arrangement, a forward modular skid shoe 54 can be swapped with a rearward modular skid shoe 58 from the same side of the pusher box. Similarly, skid shoes 50, 52 and 54, 56, 58 can be swapped with respective similar skid shoes from another side of the pusher box. It is to be appreciated, that skid shoes 50, 52 and 54, 56, 58 can be rotated and moved amongst other similar skid shoes in a corresponding fashion as rotating tires on a vehicle.

It is to be appreciated that the modular skid shoes incorporate at least two independently mountable and/or moveable skid shoes on each side of the pusher box. According to the particular and independent wear of each of the skid shoes, one or more of the skid shoes can be independently replaced with new skid shoes as needed. The benefit of only replacing a single modular skid shoe, of the present invention, represents a significant savings in materials and labor by only replacing the individual modular skid shoe that has worn to the point of replacement. In this manner, replacing the entire single fabricated component skid shoe of the prior art disclosures is avoided. Swapping out individual segments, i.e. modular skid shoes, reduces the material replacement costs as wear occurs to the skid shoes.

It is to be appreciated that each of the modular skid shoes include an independent mount and/or pivot arrangement such that each skid shoe can be mounted and/or can move independently from the other skid shoes. Alternatively, each of the skid shoes can be independently fixedly mounted to the pusher box by bolts or by welding to the sides of the respective blade. In another alternative mounting arrangement, some of the skid shoes can be mounted for pivotal movement, while other skid shoes are fixedly mounted. The skid shoes can further include compressible mounting arrangements whereby the each of the frame skid shoes provide independent suspension to the side plates and plow blade.

The modular arrangement of the skid shoes can provide for two, three, or more leading edges and two, three, or more trailing edges. Each of the modular skid shoes, once placed in active operation, will provide information about the overall wear of the pusher box. Each of the modular frame skid shoes 54, 56, 58, for example, will provide information as to which side is wearing more, whether it is in the front, the back, or the middle, or is the left side or right side.

It is to be appreciated that the multiple and independently pivotable skid shoes 54, 56, 58 enable a self-leveling of the vertical side plates and the pusher blade. The mounting arrangement of the skid shoes 54, 56, 58 can include elastomeric bushings 97 (i.e. grommet insert) surrounding the mounting bolts 94 such that the skid shoes 54, 56, 58 can pitch up and down and also roll side to side, thereby providing a leveling of the pusher plow as the plow is moved across the road surface therebelow. It is to be appreciated that the independent movement of the skid shoes 54, 56, 58, and the corresponding skid shoes mounted to the opposing vertical side plate, enable the entire pusher plow to pitch and roll, whereby the blade cutting edges can better follow the contour of the road surface therebelow. The dual mounting bolts 94 for each skid shoe 54, 56, 58 minimizes the yaw movement, thereby maintaining the skid shoes in alignment with the generally linear movement of the pusher plow forward and rearward. It is to be appreciated that in many applications of a pusher plow, the material being pushed can comprise liquids or finely granulated material such that constant contact of the cutting edges of the blade and side edges with the surface therebelow, improves the conveyance of said liquids and materials. It is to be appreciated that the terms 'pitch', 'roll', and 'yaw', as described above, are similar to the corresponding defined and commonly understood movements for a boat.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A pusher plow blade system, comprising:

a blade with horizontal and vertical reinforcing channels;

the blade further including side plates extending forward from opposing ends of the blade;

wherein each side plate includes a plurality of individual independently movable and independently replaceable skid shoes for independent sliding contact with a ground surface therebelow;

wherein each said skid shoe comprises a unified steel casting forming a replaceable steel wear part having a mounting surface and a wear surface;

each said skid shoe including an elastomeric mount for pitch movement up and down and roll movement side to side; and each said skid shoe including a direction of travel when in an engaged position.

2. The pusher plow blade system of claim 1, wherein said wear surface having at least a first-cavity integral with said wear surface;

said at least first cavity including an abrasion-resistant reconstitutable welding deposit therein, whereby abrasion action on said wear surface is reduced by said welding deposit;

said welding deposit comprising a weldment material selected from the group consisting of chrome carbide, vanadium carbide, and tungsten carbide;

said weldment material having a higher hardness than said steel-wear part for extending a service life of said wear surface of said wear part;

said welding deposit in at least said first cavity initially overfills said cavity forming a substantially bulbous deposit extending outwardly from said wear surface of said wear part; and, said bulbous deposit having a surface area and said wear surface having a surface area, wherein said bulbous deposit surface area comprises from about 30% to about 50% said wear surface area.

3. The pusher plow blade system of claim 1, wherein said plurality of skid shoes comprises a series of at least two skid shoes for attachment to each side plate, whereby said wear surface of each said skid shoe is in sliding engagement with a road surface during use thereof.

4. The pusher plow blade system of claim 3, further comprising:

said steel casting including said wear surface having a plurality of casted cavities extending along and integral with said wear surface;

said plurality of cavities each having an abrasion-resistant welding deposit therein;

said welding deposit having a higher hardness than said steel casting;

wherein said welding deposits in said plurality of cavities overfills the cavities forming substantially bulbous deposits adjacent to and extending outwardly from said wear surface of said casting; and, said plurality of cavities are spaced from one another and run along a majority of a width of said wear surface of said steel casting wherein substantially all of a surface area of said bulbous deposits is exposed to abrasive action.

5. The pusher plow blade system of claim 4, wherein said welding deposit comprises a weldment material selected from the group consisting of chrome carbide, vanadium carbide, and tungsten carbide.

6. The pusher plow blade system of claim 5, wherein said plurality of cavities are substantially parallel to one another.

7. A pusher plow blade system comprising:

a blade with horizontal and vertical reinforcing channels;

the blade further including side plates extending forward from opposing ends of the blade;

wherein each side plate includes a modular array of individual independently movable and independently replaceable skid shoes for independent sliding contact with the ground surface therebelow;

wherein each skid shoe comprises a unified steel-wear part having a mounting surface and a wear surface;

said modular array of skid shoes including a direction of travel when in an engaged position;

said modular array of skid shoes including a series of at least two skid shoes for attachment to each side plate;

each said skid shoe including an elastomeric mount for pitch movement up and down, and roll movement side to side when said modular array of skid shoes are moving in a direction of travel.

8. The pusher plow blade system of claim 7, further comprising:

said wear surface having at least a first-cavity integral with said wear surface;

said at least first cavity including an abrasion-resistant reconstitutable welding deposit therein whereby abrasion action on said wear surface is reduced by said welding deposit;

said welding deposit comprising a weldment material selected from the group consisting of chrome carbide, vanadium carbide, and tungsten carbide;

said weldment material having a higher hardness than said steel-wear part for extending a service life of said wear surface of said wear part;

said welding deposit in at least said first cavity initially overfills said first cavity forming a substantially bulbous deposit extending outwardly from said wear surface of said wear part; and, said bulbous deposit having a surface area and said wear surface having a surface area, wherein said bulbous deposit surface area comprises from about 30% to about 50% said wear surface area.

9. The pusher plow blade system of claim 8 further including a second cavity substantially aligned with said at least first cavity, said second cavity including said abrasion-resistant welding deposit therein.

10. The pusher plow blade system of claim 9, wherein said first and said second cavities are substantially parallel to one another.

11. The pusher plow blade system of claim 10, wherein said first and said second cavities are spaced from one another and run along the majority of the width of said wear surface of said steel casting.

12. A pusher plow blade system, comprising:

a blade including side plates, each side plate being mounted to opposing sides of said blade;

each said side plate includes at least two individual and independently replaceable skid shoes for sliding contact with a ground surface below;

wherein said skid shoes comprise unified steel castings each having a mounting surface and a wear surface;

said skid shoes including a direction of travel when in an engaged position; and, each said skid shoe including an elastomeric mount for pitch movement up and down and roll movement side to side.

13. The pusher plow blade system of claim 12, further comprising:

said steel casting including said wear surface having a plurality of casted cavities extending along and integral with said wear surface;

said plurality of cavities each having an abrasion-resistant welding deposit therein;

said welding deposit having a higher hardness than said steel casting;

wherein said welding deposits in said plurality of cavities overfills the cavities forming substantially bulbous deposits adjacent to and extending outwardly from said wear surface of said casting; and, said plurality of cavities are spaced from one another and run along the majority of the width of said wear surface of said casting wherein substantially all of said deposit surface area is exposed to the abrasive action.

14. The pusher plow blade system of claim 13, wherein said deposit comprising a weldment material selected from the group consisting of chrome carbide, vanadium carbide, and tungsten carbide.

15. The pusher plow blade system of claim 13, wherein said plurality of cavities are substantially parallel to one another.

16. The pusher plow blade system of claim 12, wherein said wear surface comprises an array of at least four individual, independently movable skid shoes; and, wherein said skid shoes each include a wear surface in sliding engagement with a road surface during use thereof.

17. A pusher plow blade system, comprising;

a blade including side plates, each side plate mounted to opposing sides of said blade;

each said side plate includes at least two individual and independently replaceable skid shoes for sliding contact with the ground surface therebelow;

wherein said skid shoes each include a wear surface in sliding engagement with a road surface during use thereof; and wherein said wear surfaces comprise an array of at least four individual, independently moveable skid shoes.

* * * * *